US009397442B2

(12) United States Patent
Sutter et al.

(10) Patent No.: US 9,397,442 B2
(45) Date of Patent: Jul. 19, 2016

(54) CONNECTOR HAVING A LATCH WITH A LOCATING MEMBER AND A TOOTH WITH A NOTCH

(71) Applicant: Molex Incorporated, Lisle, IL (US)

(72) Inventors: Steven George Sutter, Maumelle, AR (US); Darian Schulz, Little Rock, AR (US); Kent E. Regnier, Lombard, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/761,358

(22) PCT Filed: Jan. 16, 2014

(86) PCT No.: PCT/US2014/011852

§ 371 (c)(1),
(2) Date: Jul. 16, 2015

(87) PCT Pub. No.: WO2014/113570

PCT Pub. Date: Jul. 24, 2014

(65) Prior Publication Data

US 2015/0364865 A1 Dec. 17, 2015

Related U.S. Application Data

(60) Provisional application No. 61/753,029, filed on Jan. 16, 2013, provisional application No. 61/757,299, filed on Jan. 28, 2013, provisional application No. 61/760,433, filed on Feb. 4, 2013, provisional application No. 61/868,704, filed on Aug. 22, 2013.

(51) Int. Cl.

| | |
|---|---|
| ***H01R 13/627*** | (2006.01) |
| ***H01R 24/62*** | (2011.01) |
| ***H01R 12/70*** | (2011.01) |

(Continued)

(52) U.S. Cl.

CPC ..... *H01R 13/6273* (2013.01); *H01R 12/7076* (2013.01); *H01R 13/6471* (2013.01); *H01R 13/6473* (2013.01); *H01R 13/6582* (2013.01); *H01R 24/60* (2013.01); *H01R 24/62* (2013.01); *H01R 2107/00* (2013.01)

(58) Field of Classification Search

CPC .. H01R 13/62; H01R 13/627; H01R 13/6271; H01R 13/6273; H01R 13/639

USPC ..... 439/345, 352, 355

See application file for complete search history.

(56) References Cited

U.S. PATENT DOCUMENTS 6,352,444 B1 * 3/2002 Yuzawa ..... H01R 13/514 385/56
6,659,796 B1 * 12/2003 Waddell ..... H01R 12/7047 439/352
7,192,297 B1 * 3/2007 Wu ..... H01R 12/592 439/353

(Continued)

*Primary Examiner* — Chandrika Prasad
(74) *Attorney, Agent, or Firm* — Stephen L. Sheldon

(57) ABSTRACT

A cable connector is provided having an insulative housing, a conductive shield and a pair of latching members. Each latching member has free ends with engagement teeth formed thereon which are separated by an intervening engagement notch. The sidewalls of the engagement notch are flat and define hard stop surfaces in opposing directions for engagement by each latching member with an opposing board connector. The free ends further include ramped surfaces leading to the engagement notch to form cam surfaces that depress each latching member when the cable connector is mated to a board connector. Each latching members may also include locating tabs captured in vertical movement by the cable connector body.

28 Claims, 10 Drawing Sheets

(51) Int. Cl.

| | |
|---|---|
| ***H01R 13/6471*** | (2011.01) |
| ***H01R 13/6473*** | (2011.01) |
| ***H01R 24/60*** | (2011.01) |
| ***H01R 13/6582*** | (2011.01) |
| *H01R 107/00* | (2006.01) |

(56) References Cited

U.S. PATENT DOCUMENTS

| | | | | |
|---|---|---|---|---|
| 7,322,845 | B2 * | 1/2008 | Regnier | H01R 13/6335 439/352 |
| 7,354,292 | B1 * | 4/2008 | Lloyd | H01R 13/6272 439/352 |
| 8,100,709 | B2 * | 1/2012 | Zhang | H01R 13/6275 439/353 |
| 2004/0077196 | A1 | 4/2004 | Martin et al. | |
| 2009/0004916 | A1 | 1/2009 | Miyoshi et al. | |
| 2010/0081303 | A1 | 4/2010 | Roth et al. | |
| 2011/0294334 | A1 | 12/2011 | Phillips et al. | |
| 2012/0077365 | A1 | 3/2012 | Kobayashi et al. | |
| 2014/0030899 | A1 * | 1/2014 | Crighton | H01R 24/20 439/176 |

* cited by examiner

CONNECTOR HAVING A LATCH WITH A LOCATING MEMBER AND A TOOTH WITH A NOTCH

REFERENCE TO RELATED APPLICATIONS

The Present Disclosure claims priority to prior-filed U.S. Provisional Patent Application Nos. 61/753,029, entitled "IO Connector," filed on 16 Jan. 2013; 61/757,299, entitled "Low Profile Connection System," filed on 28 Jan. 2013; 61/760,433, entitled "Low Connector Profile System," filed on 4 Feb. 2013; and 61/868,704, entitled "Bi-Directional Latch," filed on 22 Aug. 2013. Each of these Applications have been assigned to the same Assignee as the Present Disclosure. Additionally, the Present Disclosure is related to PCT Patent Application No. PCT/US2014/011838 (Molex Internal Reference No. B2-226 WO), entitled "Low Profile Connector System," filed on 16 Jan. 2014, the same day as the Present Disclosure, and having the same inventors as the Present Disclosure, and assigned to the same Assignee as the Present Disclosure. Each of these Applications were filed with the United States Patent and Trademark Office. Further, the content of each of these Applications are incorporated in their entireties herein.

BACKGROUND OF THE PRESENT DISCLOSURE

The Present Disclosure relates, generally, to electrical connectors, and, more particularly, to connectors of small size, such as low-profile connectors, with improved latching mechanisms.

It is important to have adequate connector wipe in connectors of small size in order to ensure proper and reliable contact between the terminals of two opposing, interengaging connectors. Current connectors available in the marketplace rely upon many different components in order to define the necessary hardstops that ensure proper mating between the two connectors. Additionally, because the desired current connector environment is very small, the incorporation of active latching mechanisms presents challenges for the designer in establishing reliable tolerances.

The Present Disclosure is therefore directed to an improved latching mechanism particularly suitable for use in connectors of small pitch that reliably capture a latching member in its latching movement to reduce deflection thereof, so that mating with an opposing connector is more reliable. The latching member includes a pair of opposing hardstops to maintain engagement with the opposing mating connector, and actuating surfaces configured to move the latching member out of and into engagement with an opposing connector during mating.

SUMMARY OF THE PRESENT DISCLOSURE

Accordingly, the Present Disclosure discloses an improved latching mechanism suitable for use in connectors of small pitch, which provides bidirectional characteristics and reliable engagement.

In accordance with one embodiment of the Present Disclosure, a cable connector is provided with a connector body including a plurality of conductive terminals to which wires of the cable are terminated. The terminals extend lengthwise, or axially, within the connector housing, and are supported on the connector body in a position for mating with like corresponding terminals of an opposing, mating connector. The cable connector includes a conductive outer shell that provides shielding to the terminals, and a grounding aspect to the connector and this outer shell, or shroud, encompasses the terminals and is received within a corresponding shield of the opposing connector, which is typically mounted to a circuit board. Two latching members are preferably associated with the cable connector body for engaging the opposing board connector.

The opposing board connectors have insulative body portions which support conductive terminals, the terminals being encompassed by an associated outer conductive shield. The latching members are secured on the cable connector body and extend in a cantilevered fashion so that free ends thereof define latching arms with engagement ends. Due to their cantilevered structure, the latching member free ends are free to deflect under loading. The latching members extend along opposite sides of the connector body and their free ends extend within the cable connector shield. The latching arms are preferably offset so that they can be actuated by pressing a portion of the connector housing, and their free ends are received within the cable connector shield without interference. Portions of the latching member free ends project out through associated openings in the cable connector shield to provide engagement surfaces that engage the shield of the opposing board connector.

The latching members, according to the Present Disclosure, include engagement slots, or notches, formed in the free ends of the latching members. These engagement notches preferably extend vertically, or perpendicularly, to the longitudinal axes of the latching members. As such, the notches include associated pairs of latching teeth, or hooks, with the latching teeth including planar faces on opposite sides of the slots that define leading and trailing engagement surfaces configured to confront and engage opposing engagement surfaces formed in the shield of the opposing, mating board connector. In order to provide these engagement surfaces, the board connector shield preferably includes openings spaced rearwardly from the front edge thereof. The openings define intervening tabs, or locking bars, each of which includes two opposing engagement surfaces which confront the engagement surfaces of the latching teeth notch on the cable connector latching member free ends.

In order to provide the latching members with a bi-directional operation aspect, each latching member preferably includes a pair of ramped surfaces that extend in opposite directions, forwardly and rearwardly, from their associated engagement surfaces of the notches. The forward ramped surface will engage the front edge of the board connector shield and deflect the latching member free end downwardly as the cable connector is pushed forwardly into the board connector shield. The latching member free end then tracks the inside surface of the board connector shield until it encounters a corresponding opening in the board connector shield. It then springs upwardly so that its forward tooth extends into the opening and its notch contains the locking tab, or bar of the board connector shield. An actuation tab may be provided that extends into contact with the connector housing so that pressure on the connector housing depresses the latching members. The actuation tabs are positioned on the latching members at an elevation above the free ends thereof.

In another embodiment of the Present Disclosure, a means to capture the vertical movement of the latching members is provided. The latching member is provided, in this embodiment, with a vertical locating tab that preferably depends downwardly from a body of the latching member. The connector body includes a corresponding vertical slot into which the locating tab projects and is free to move. The locating tab thereupon is captured in the slot of the connector body; this structure prevents deflection of the latching members in the horizontal direction.

These and other objects, features and advantages of the Present Disclosure will be clearly understood through a consideration of the following detailed description.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

Figure 1:
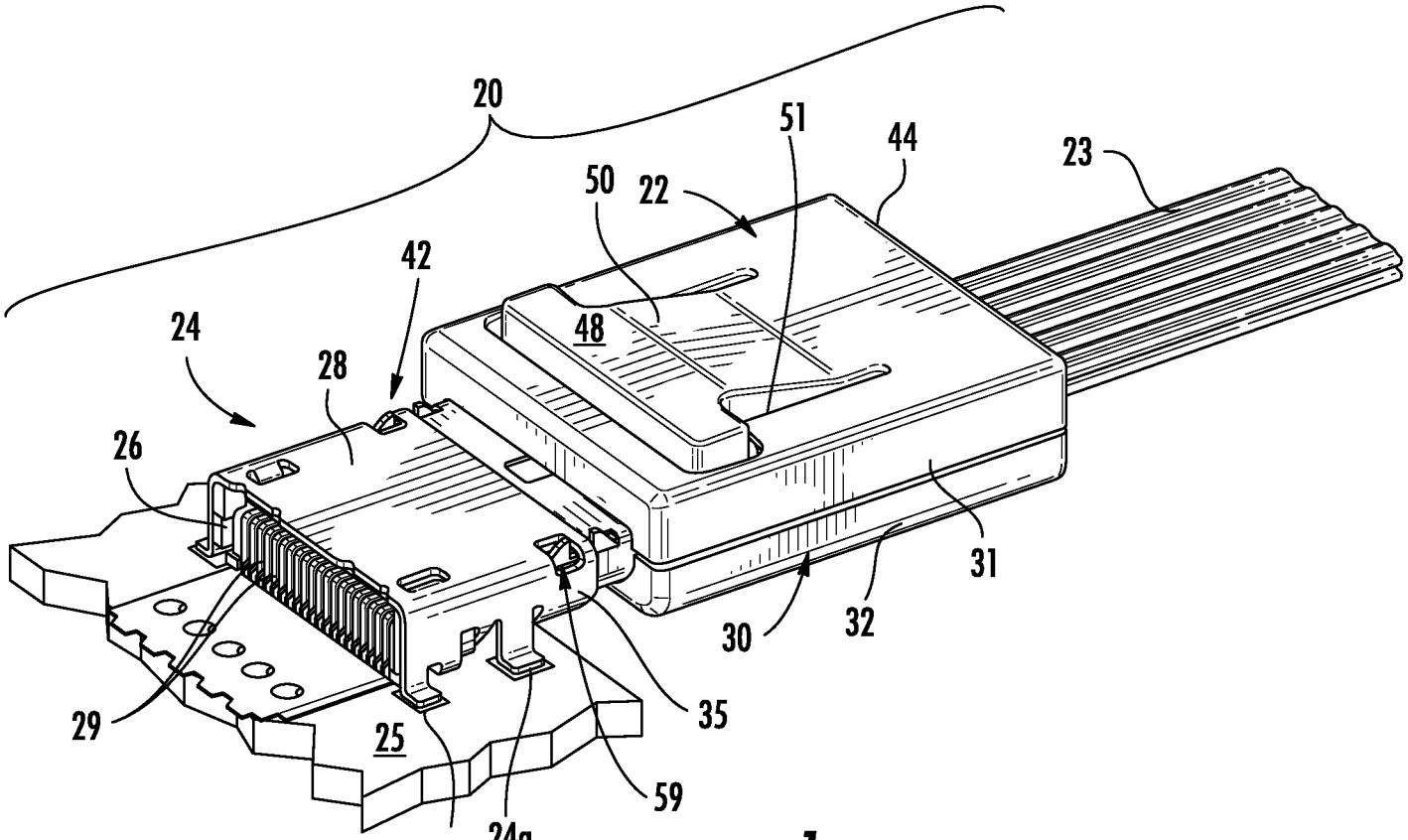
FIG. 1 is a perspective view of a mated connector assembly incorporating latching mechanisms, constructed in accordance with the principles of the Present Disclosure.
Figure 2:
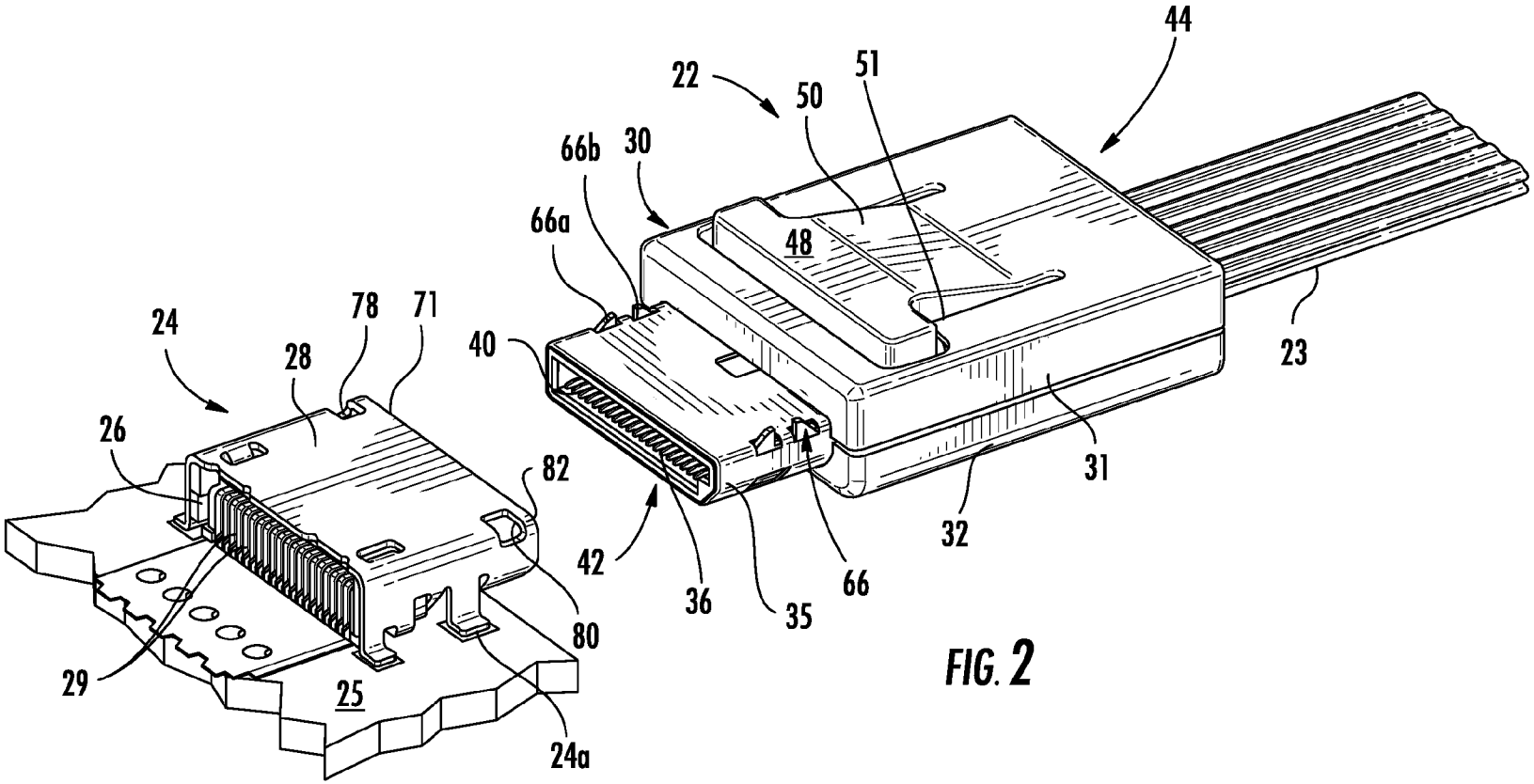
FIG. 2 is the same view as FIG. 1, but with the two opposing connectors illustrated in a unmated condition.
Figure 3:
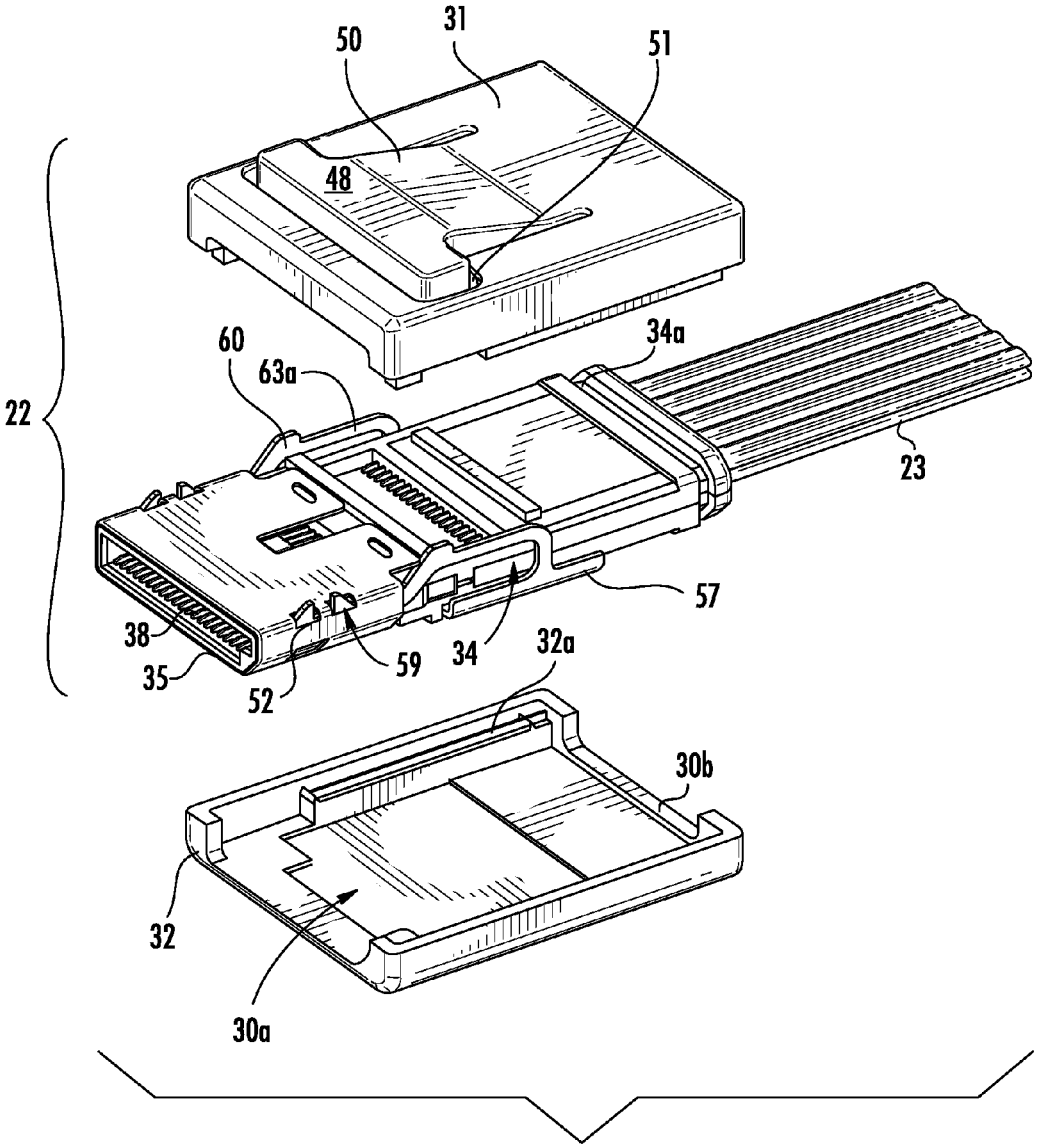
FIG. 3 is the same view as FIG. 2, but with the connector housing removed for clarity purposes.

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

FIGS. 1-8 illustrate a connector assembly 20, constructed in accordance with the principles of the Present Disclosure, which utilizes a cable connector 22 and a circuit board connector 24 engaged in a mating condition. The cable connector 22 is used to connect a plurality of cable wires 23 to circuits on a circuit board 25 that may be housed within an electronic device (not shown). The board connector 24 has an insulative body, or housing, 26 that supports a plurality of conductive terminals 29, tail portions 29*a* of which (illustrated more closely in FIG. 7) extend out of the rear of the connector housing 26 and contact portions of which (not shown) extend along the housing 26 within the hollow interior of an exterior grounding shield 28. The board connector 24 includes mounting feet 24*a* that may be attached to the circuit board by soldering to mounting pads 25*a* or by way of compliant pins or the like.

The cable connector 22 has an insulative connector housing 30 formed form two interengaging halves 31, 32 (shown most clearly in FIG. 3) that cooperatively define a hollow interior 30*a* that houses a connector body 34 therein. The connector body 34 supports a plurality of conductive terminals 36 that have termination tails (not shown) and contact portions 38. The terminals 36 extend lengthwise of the connector body 34, and the connector body 34 includes a series of slots 40 disposed proximate a mating end 42 thereof, wherein each slot receives a portion of the terminal contact portions 38. These slots 40 permit the terminal contact portions 38 to deflect vertically under the insertion pressure of a mating blade of the opposing board connector 24 as is known in the art. The connector halves 31, 32 may include a ridge 30*b* disposed at their rear exit portions which are received in an opposing channel 34*a* defined at the rear end of the connector body 34 so that the housing 30 is properly and reliably engaged with the connector body 34.

The cable connector 22 may further be provided with an actuation tab, or button, 48 disposed on the top surface of the housing half 31. The button is shown in the Figures as having an overall T-shape. It will be understood that other configurations may be used, both of the shape of the actuation tab, and of the cable connector itself. The button 48 is shown formed integral with the connector housing half 31, and is partially separated therefrom by an intervening slit, or cut, 51 that outlines most of the T-shape of the actuation button 48, but is not continuous in nature to form a cantilevered support for the button 48. At least the bottom connector half 32 includes appropriately-sized recesses aligned with the actuation button 48 and the lower beam portion 63*b* of the latching member 58 to permit the beam portion 63*b* to be depressed and return to its original position without interference with the connector housing 30.

A conductive shield, or shroud, 35 is provided, which fits over the mating end 42 of the connector body portion that supports the terminal contact portions 38. The shroud 35 has a hollow interior 35*a* and one or more openings 54 that may be stamped therein which engage raised bosses 53 formed on the connector body 34. The shroud provides a shield resistant to electromagnetic interference ("EMI") at the connector mating interface, and also provides a first mate-last break ground contact for the cable connector 22. As illustrated, the shroud 35 includes a non-uniform configuration so that it may be inserted into the opposing board connector 24 in only the correct orientation. When the shroud 35 is attached to the connector body 34, it partially encloses the terminals 36 with a conductive shield, and has openings 52 formed therein that permit the latching teeth 66 of the cable connector latching members 56 to project therethrough, as will be explained in more detail below.

Figure 4:
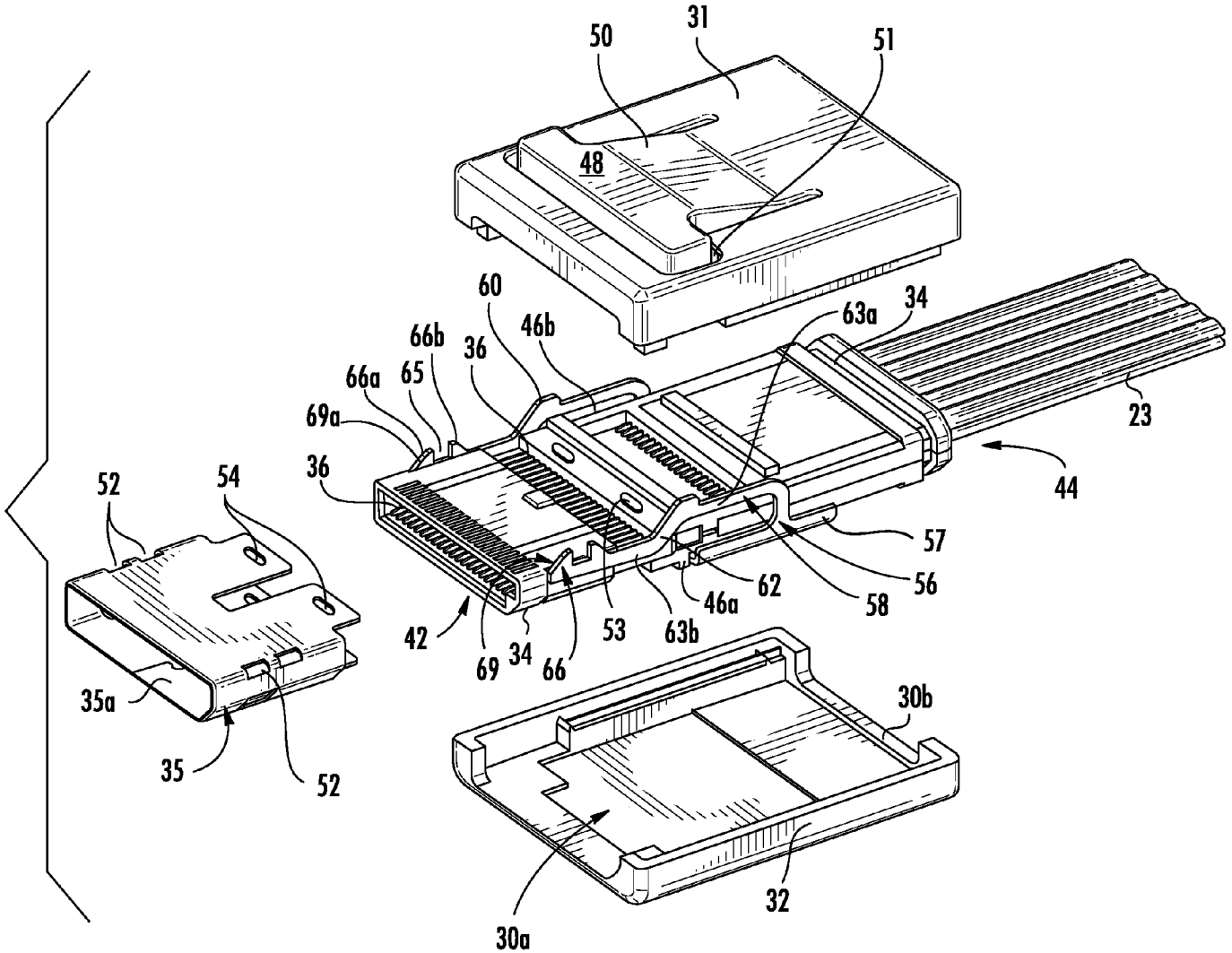
FIG. 4 is the same view as FIG. 3, but with the front shield shown removed from the connector body.
Figure 5:
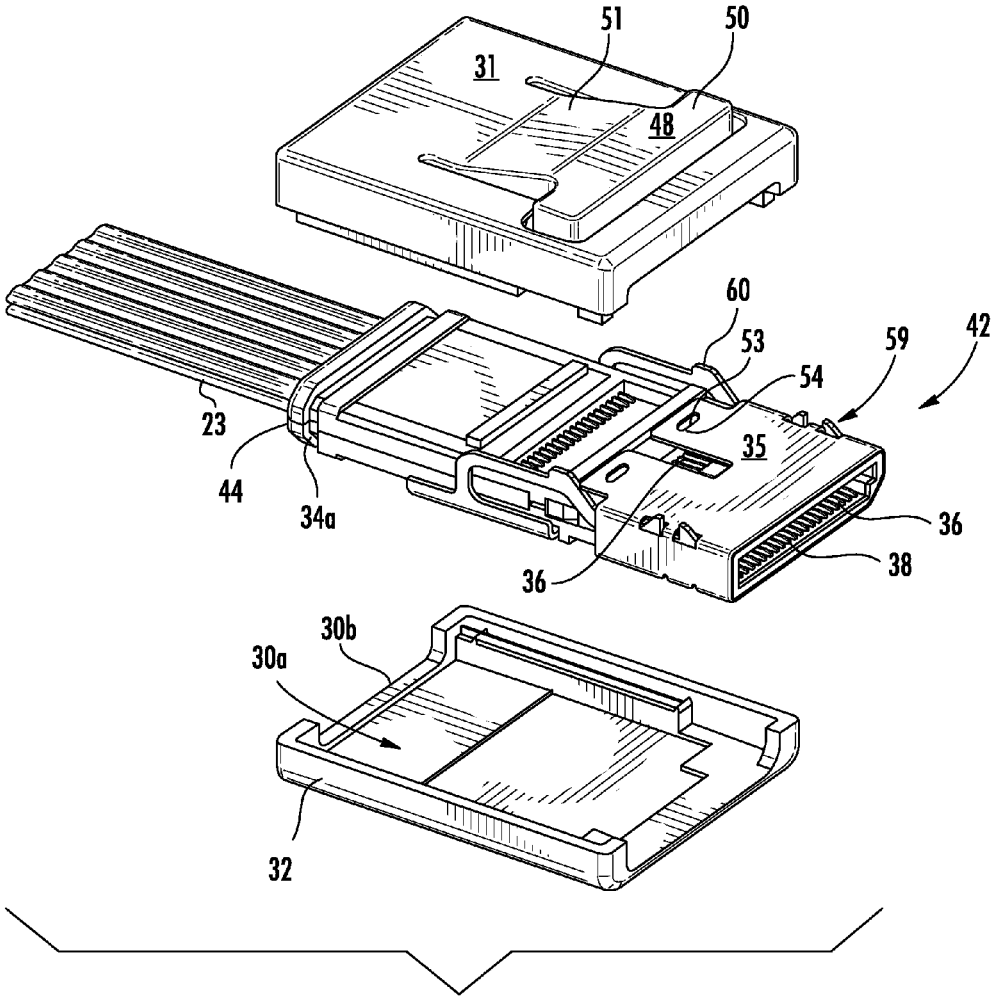
FIG. 5 is an exploded view of the cable connector from the opposite side of FIG. 1, with the connector housing removed to show the latching mechanism in place upon the connector body.
Figure 6:
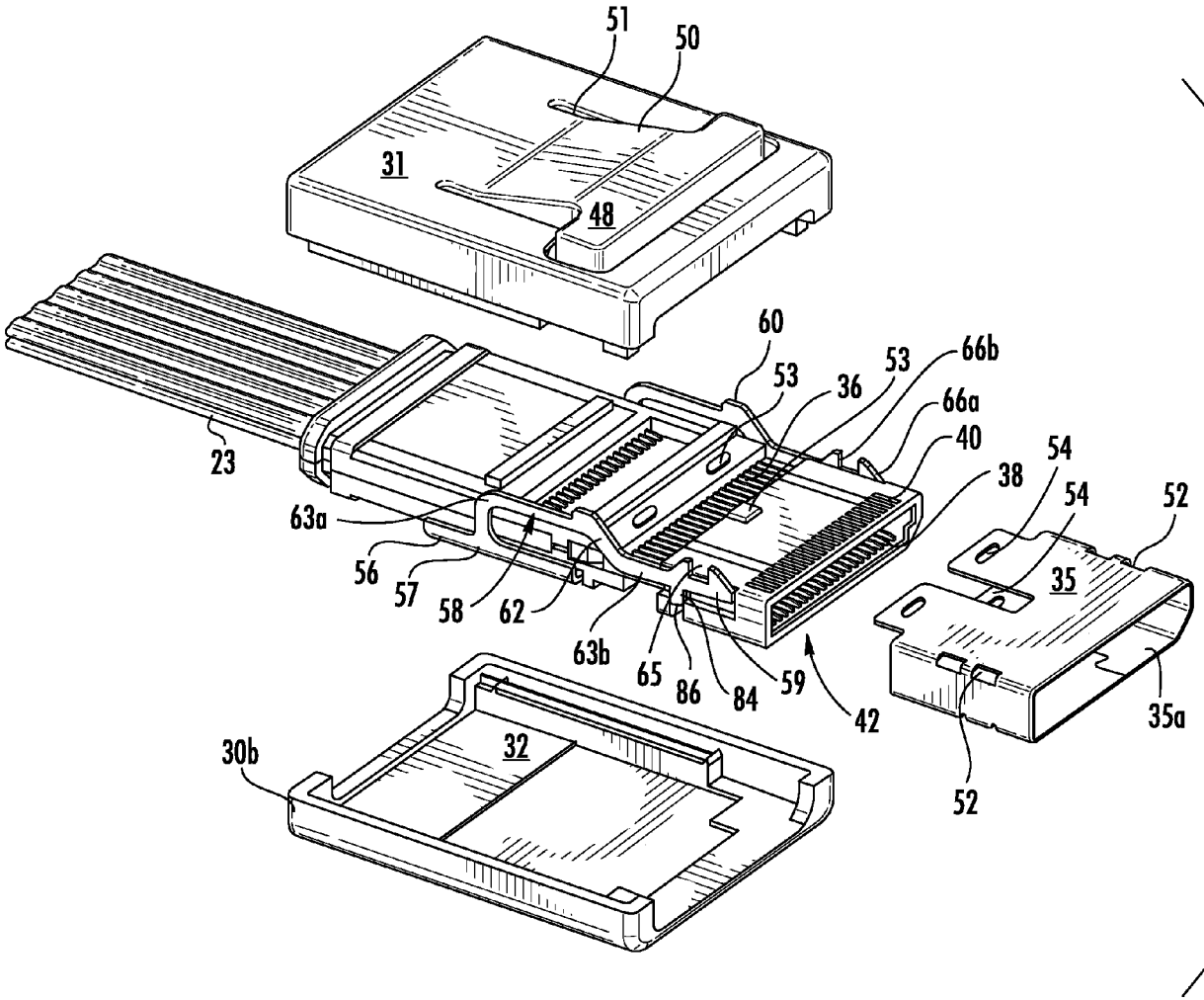
FIG. 6 is the same view as FIG. 5, but with the grounding shield removed to expose the free ends of the latching members to view.
Figure 7:
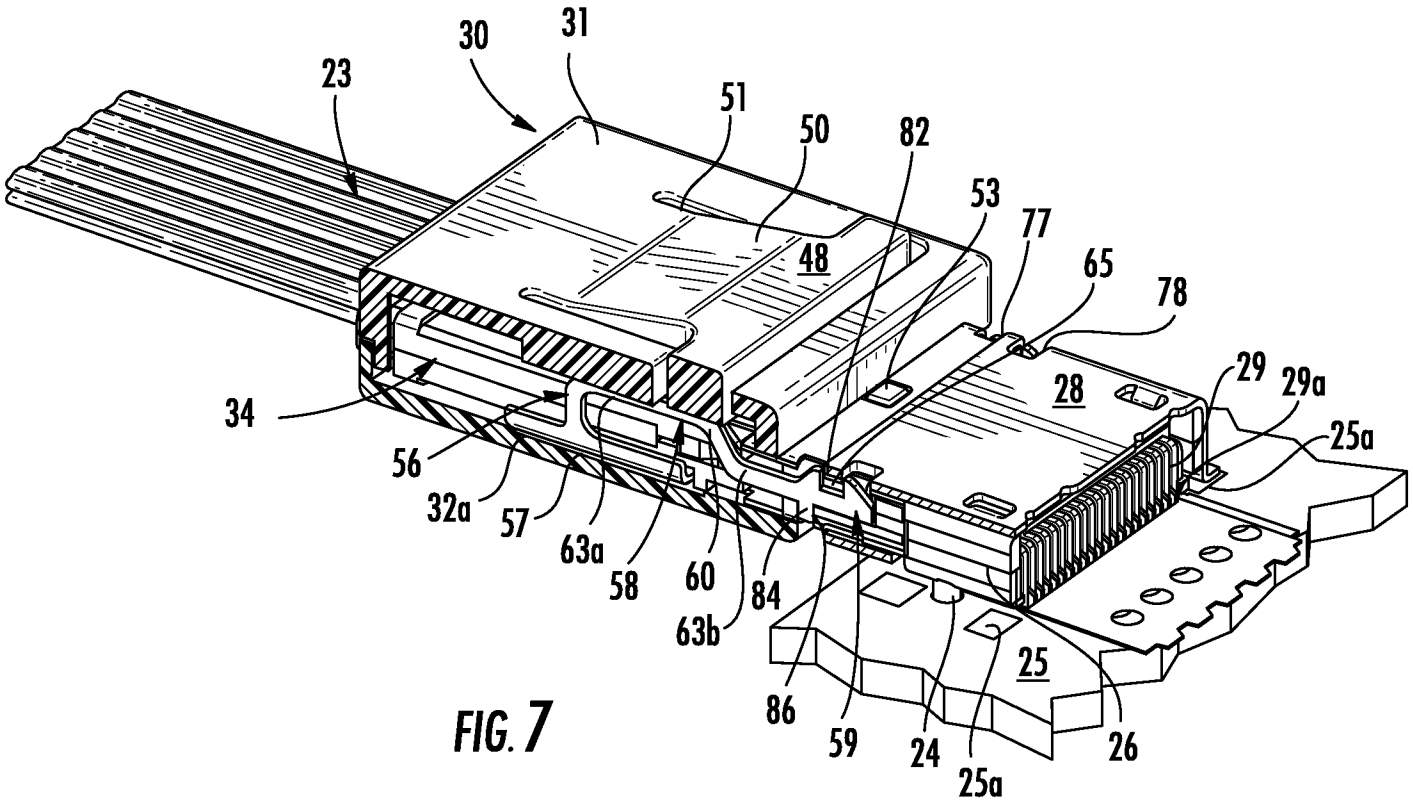
FIG. 7 is a sectional view of the connector assembly of FIG. 1 showing one latching member in a depressed condition.
Figure 8:
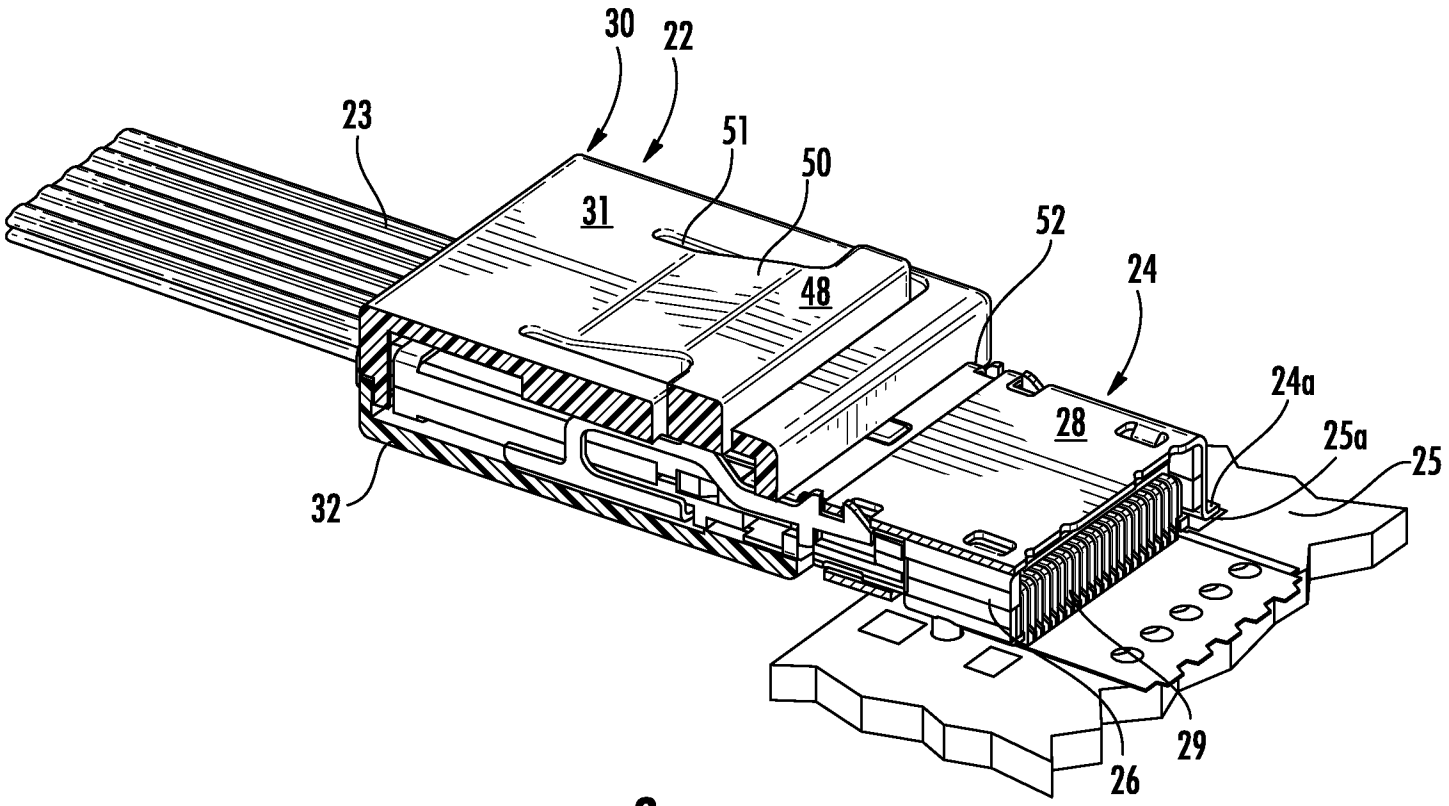
FIG. 8 is the same view as FIG. 7, but with the latching member extended upwardly into engagement with the shield of the board connector.
Figure 9:
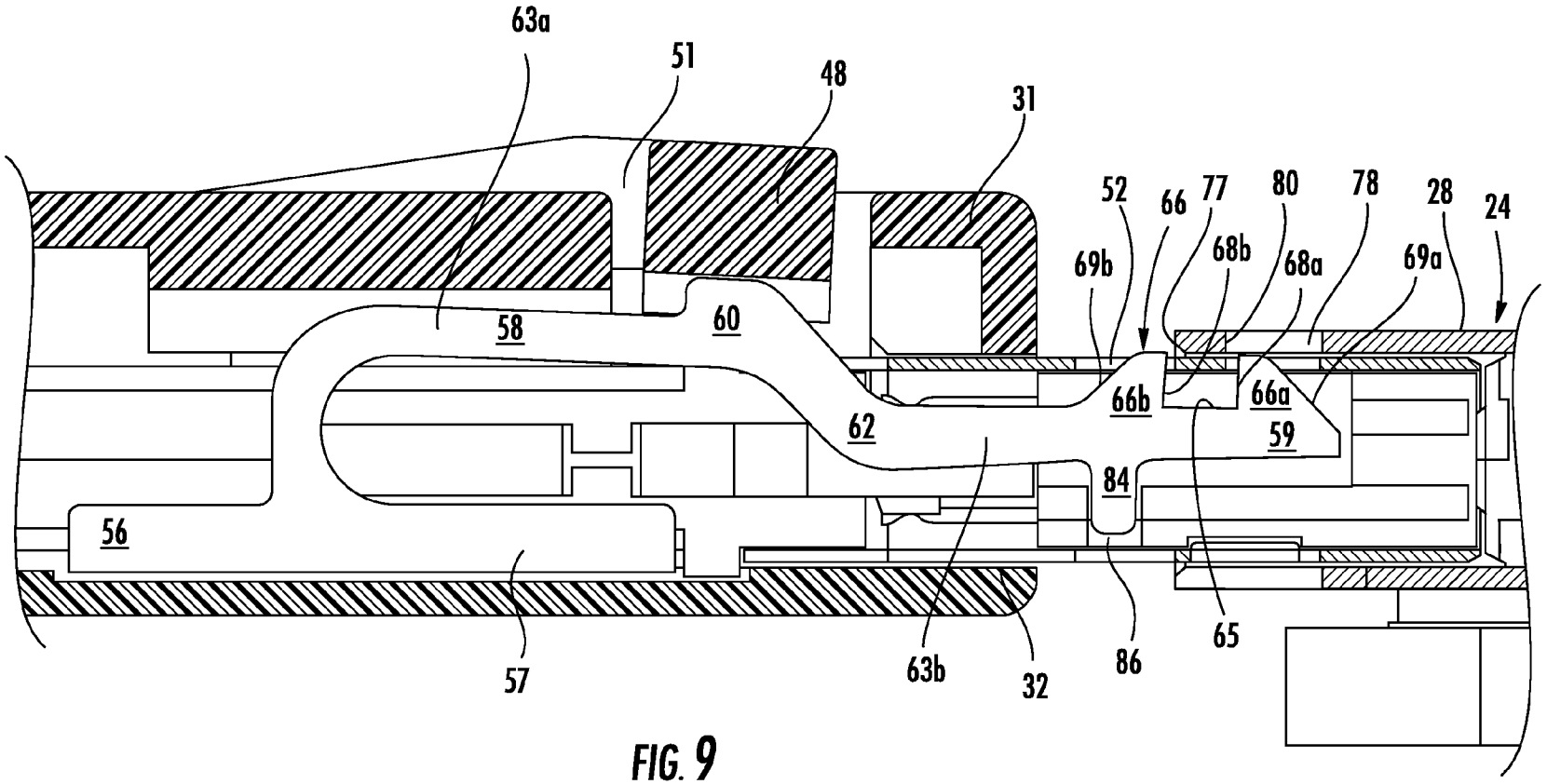
FIG. 9 is an enlarged detail view of FIG. 7.
Figure 10:
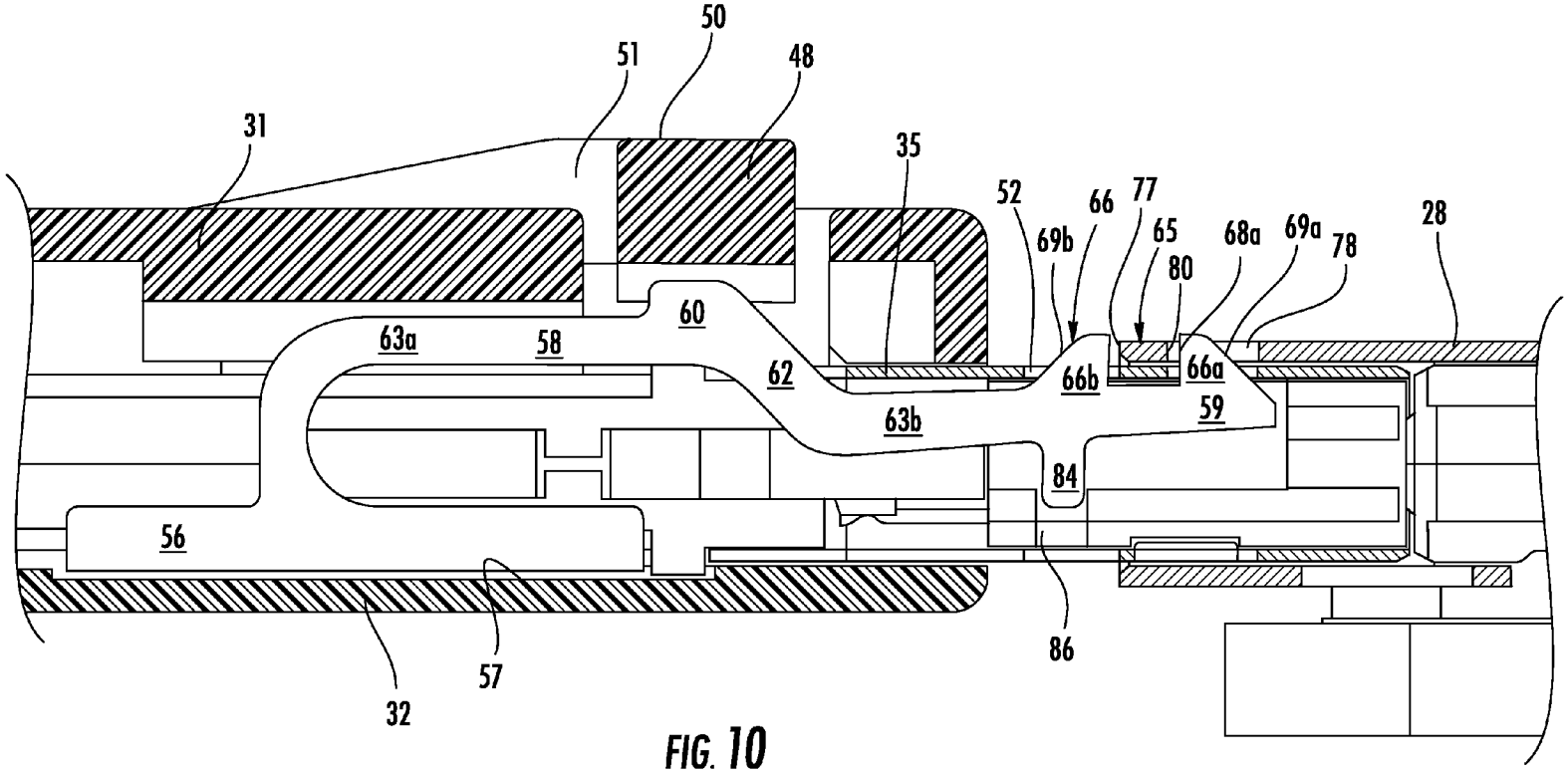
FIG. 10 is an enlarged detail view of FIG. 8.

With attention to FIGS. 4 and 9-10, it can be seen that the cable connector 22 includes a pair of elongated latching members 56 supported on opposite sides of the connector body 34 and which extend through a portion of the connector housing 30 and within the connector shroud 35. The latching members 56 have a base end, or retention portion, 57 that secures the member in place to the connector housing 30. In the embodiment illustrated, the base end 57 is L-shaped and retained in a slot formed in the connector housing top half 31 that opposes a pair of rails 32*a* of the connector housing bottom half 32. The latching members 56 rise up from the base ends 57 and extend along body, or beam, portions 58, which terminate in free ends 59. The beam portions 58 have an offset configuration 62 dividing the beam portions into top and bottom portions 63*a*, 63*b*, respectively. This configuration allows the latching member free ends 59 to extend within the terminal contact area of the connector body 34 encircled by the shroud 35.

The latching member free ends 59 include pairs of latching teeth, or hooks, 66 with a leading, or first, latch tooth 66*a* and a trailing, or second, latch tooth 66*b*. The two latching teeth 66*a*, 66*b* are separated by an intervening engagement slot, or notch, 65 having a dimension sufficient to accommodate a locking bar, or tab, 82 of the opposing board connector shield 28 therein. In order to provide reliable and positive engagement, the notches 65 include planar sidewalls 68 having respective leading and trailing edges 68*a*, 68*b*. These edges 68*a*, 68*b* serve as engagement surfaces as they confront like engagement surfaces of the opposing board connector shield 80, 84, as best illustrated in FIGS. 9-10. The leading edges 68*a* of the notches 65 serve as stop surfaces that prevent unintended unmating of the two connectors 22, 24, as the cable connector cannot be withdrawn from its mating engagement with the board connector 24 unless the latching member free ends 59 are depressed. Similarly, the trailing edges 68*b* serve as stop surfaces to prevent over insertion of the cable connector 22 into the board connector 24.

The latching member free ends 59 also may include ramped, or cam, surfaces 69 that flank the engagement notches 65. The cam surfaces 69 have distinct leading and trailing portions 69*a*, 69*b*. The cam surfaces 69 are shown as having an angled and a flat portion, but it will be understood that they may have continuous angled or arcuate configurations. The cam surfaces 69 communicate with the notches 65, as they are joined at their terminal ends to the notch sidewalls 68*a*, 68*b*. The leading cam surface 69*a* will ride upon the front edge 77 of the board connector shield 28 so that the free end 59 deflects downwardly and the latching tooth 66*a* rides upon the inner surface of the board connector shield 28 until it encounters the board connector shield opening 78 and springs up into that opening.

The notch trailing edge 68*b* confronts the board connector shield front edge 77 and provides a hard stop surface that limits the extent to which the cable connector 22 may be inserted into the board connector 24. Likewise, the engagement notch leading edge 68*a* provides a hard stop that limits the extent to which the cable connector 22 an be unintentionally withdrawn (or unmated) from the board connector 24 as it contacts the board connector shield edge 80. This contact is released when the actuation button is depressed. This mating engagement control is important given the size of the connectors contemplated by the Present Disclosure, equal to or less in size than USB style connectors with terminal pitches of 0.5 mm or less. The leading cam surface 69*a* causes deflection of the latching member free ends 59 without any separate actuation. It can be seen that the notches and the hard stops that they provide control the amount of positive and negative wipe desired for the terminals of the connector assembly 20.

In another embodiment, one or more of the latching members 58 may be provided with a means for locating the latching member 58 along the connector body 34 and controlling the deflection of the latching member free ends 59. The means, as illustrated, includes a locating tab 84 that extends at an angle from the latching member beam bottom portion 63*b*. The locating tab 84 is shown as aligned with and positioned underneath the rear latching tooth 66*b* in the Figures, but it is understood that it may be located elsewhere along the latching member body portion 58.

The free end of the locating tab 84 is partially captured in the connector body channel 86 in both the deflected and undeflected conditions of the latching member free ends 59. The locating tab 84 constrains the latching member free ends 59 to substantially vertical movement and prevents unintended horizontal deflection of the latching members due to stubbing as it provides a reaction surface much closer to the free ends 59. Although shown as depending downwardly, the locating tab 84 may extend upwardly dependent on the connector body design.

While a preferred embodiment of the Present Disclosure is shown and described, it is envisioned that those skilled in the art may devise various modifications without departing from the spirit and scope of the foregoing Description and the appended Claims.

What is claimed is:

1. A connector, the connector comprising:

a connector housing, the connector housing supporting a plurality of conductive terminals extending lengthwise therewithin, each terminal including termination portions and contact portions at opposite ends, the contact portions being disposed proximate a mating end of the connector; and at least one latching member for latching the connector to an opposing connector, each latching member including a base end fixed to the connector, a free end proximate the mating end, a body portion interconnecting the base and free ends such that each latching member has a cantilevered structure, at least one engagement member disposed proximate the free end for engaging a portion of the opposing connector, and a locating member extending at an angle from the body portion;

wherein the connector housing includes a channel formed therein, the channel receiving each locating member, guiding the locating member in vertical movement.

2. The connector of claim 1, wherein the channel fixes a horizontal location of each engagement member by constraining horizontal movement thereof.

3. The connector of claim 1, further including a second latching member, each latching member being disposed along opposite sides of the connector.

4. The connector of claim 3, wherein the second latching member includes a base end fixed to the connector, a free end proximate the mating end, a body portion interconnecting the second latching member base and free ends such that the second latching member also has a cantilevered structure, and an engagement member proximate the second latching member free end for engaging a portion of the opposing connector.

5. The connector of claim 4, wherein each engagement member includes pairs of latching teeth, the latching teeth being separated by intervening notches, the notches being at least partially defined by a pair of planar, spaced-apart sidewalls.

6. The connector of claim 5, wherein each latching member includes ramped surfaces extending lengthwise thereon and extending toward the notches.

7. The connector of claim 6, wherein the ramped surfaces communicate with the notches.

8. The connector of claim 7, wherein the ramped surfaces end at the sidewalls of the notches.

9. The connector of claim 5, wherein the sidewalls define pairs of stop surfaces for engaging the opposing connector during insertion and removal of the connector therewith.

10. The connector of claim 1, wherein the channel prevents drifting of each latching member horizontally.

11. The connector of claim 1, wherein each latching member further includes an actuating tab that extends at an angle to the latching member body, the actuating tab being configured to contact an actuator member associated with the connector housing such that pressure upon the actuator member causes each free end to move vertically.

12. A connector with a bi-directional latching mechanism, the connector comprising:

a connector housing supporting a plurality of conductive terminals, each terminal including tail portions and contact portions for contacting opposing terminals of an opposing connector, the contact portions disposed proximate a mating end of the connector housing;

a conductive shroud supported by the connector housing, the shroud enclosing the contact portions and providing a conductive surface for mating with a shield of the opposing connector; and a pair of latching members supported by the connector housing, each latching member including a base fixed in place with respect to the connector housing and a free end extending lengthwise from the bases in a cantilevered fashion, the base and free ends being interconnected by an intervening body portion, the free end including pairs of latch teeth which extend vertically with respect to the body portion, each pair of latching teeth being separated by a gap, each gap including leading and trailing edges which extend vertically with respect to the body portion, the trailing edges of each gap defining stop surfaces that limit the extent to which the connector can be inserted into mating engagement with the opposing connector, the leading edges of each gap defining stop surfaces that prevent unintended removal of the connector from mating engagement with the opposing connector.

13. The connector of claim 12, wherein each latching member further includes an actuating member that extends vertically into contact with a portion of the connector housing such that when pressure is applied to the connector housing, the engagement ends deflect vertically.

14. The connector of claim 13, wherein each body portion has an offset configuration such that the actuating member thereof is positioned at different elevations than the engagement ends.

15. The connector of claim 13, wherein each actuating member extends vertically from the body portion and each gap is open along top portions of the free ends.

16. The connector of claim 12, wherein each latching member further includes pairs of cam surfaces associated with the latching teeth and extending in different directions than the leading and trailing edges, each pair of cam surfaces including distinct leading and trailing edges.

17. The connector of claim 16, wherein each cam surface leading edge communicates with one gap leading edge, and the cam surface trailing edge communicates with one gap trailing edge.

18. The connector of claim 17, wherein the cam surfaces are ramps.

19. The connector of claim 12, wherein the shroud includes pairs of openings through which the latching teeth extend.

20. The connector of claim 19, wherein the latching teeth have a height sufficient to project through the openings and into engagement with the opposing connector.

21. The connector of claim 12, wherein at least one of the latching members further includes a locating tab extending vertically therefrom, and the connector housing further includes a channel that receives at least a portion of the locating tab therein, the channel restraining the latching teeth to substantially vertical movement.

22. A cable connector with a bi-directional latching mechanism, the cable connector comprising:

a connector housing supporting a plurality of conductive terminals, each terminal including tail portions for terminating to wires and contact portions for contacting opposing terminals of an opposing connector, the contact portions disposed proximate a frontal mating end of the connector housing;

a conductive shroud supported by the connector housing, the shroud encircling the terminal contact portions for mating with a conductive portion of the opposing connector; and a pair of latching members supported by the connector housing for latching the cable connector to the opposing connector after mating therewith, each latching member including a first ends fixed in place with respect to the connector housing, and a second end disposed on cantilevered beam portions that interconnect the first and second ends together, each second end including a plurality of latching teeth extending vertically with respect to the beam portions, pairs of the latching teeth including engagement notches interposed between the latching teeth pairs, each engagement notch including opposing, vertical leading and trailing edges, the trailing edges defining first stop surfaces of each notch that limits the insertion of the connector into the opposing connector, the leading edges defining second stop surfaces that prevent unintended removal of the connector from the opposing connector.

23. The cable connector of claim 22, wherein each latching member further includes an actuating member extending into contact with a deflectable portion of the connector housing, whereby, when a pressure is applied to the connector housing deflectable portion, the latching teeth are deflected vertically.

24. The cable connector of claim 23, wherein the beam portions include an offset configuration such that the actuating members thereof are vertically spaced apart from the latching teeth.

25. The cable connector of claim 24, wherein each actuating member extends along a top of the beam portions, and each notch is open along a top of the latching teeth.

26. The cable connector of claim 22, wherein the latching teeth further includes respective cam surfaces extending at an angle to, and communicating with, the notch leading and trailing edges.

27. The cable connector of claim 22, wherein the connector shroud includes a plurality of openings, the latching teeth extending vertically through the openings, the latching teeth having a height sufficient to project through the openings and into engagement with confronting surfaces of the opposing connector.

28. The cable connector of claim 22, wherein at least one of the latching members further includes a locating tab extending vertically from the beam portion, and the connector housing further includes a vertical channel, the locating tab extends into the channel, the channel restraining the latching teeth to substantially vertical movement.

* * * * *